US005842289A

United States Patent [19]

Chandran et al.

[11] Patent Number: 5,842,289

[45] Date of Patent: Dec. 1, 1998

[54] APPARATUS FOR DRYING AND HEATING USING A PULSE COMBUSTOR

[75] Inventors: Ravi Chandran, Ellicott City; Momtaz N. Mansour, Highland, both of Md.

[73] Assignee: Manufacturing and Technology Conversion International, Inc., Baltimore, Md.

[21] Appl. No.: 804,101

[22] Filed: Feb. 20, 1997

Related U.S. Application Data

[62] Division of Ser. No. 558,275, Nov. 13, 1995, Pat. No. 5,638,609.

[51] Int. Cl.[6] ..... F26B 17/00

[52] U.S. Cl. ..... 34/579; 34/585; 34/191

[58] Field of Search ..... 34/365, 329, 330, 34/340, 351, 373, 378, 379, 402, 478, 479, 792, 579, 585, 77, 84, 86, 102, 169, 191, 210, 219; 110/224; 432/14, 16, 17, 27, 96, 222

[56] References Cited

U.S. PATENT DOCUMENTS

| | | |
|---|---|---|
| 2,619,415 | 11/1952 | Hemminger . |
| 2,937,500 | 5/1960 | Bodine, Jr. . |
| 3,246,842 | 4/1966 | Huber . |
| 3,738,290 | 6/1973 | Belter . |
| 3,906,873 | 9/1975 | Green et al. . |
| 4,183,145 | 1/1980 | Piterskikh et al. . |
| 4,260,361 | 4/1981 | Huber . |
| 4,306,506 | 12/1981 | Rotter . |
| 4,331,451 | 5/1982 | Isogaya et al. . |
| 4,368,677 | 1/1983 | Kline . |
| 4,395,830 | 8/1983 | Lockwood . |
| 4,417,868 | 11/1983 | Putnam . |
| 4,499,833 | 2/1985 | Grantham . |
| 4,529,377 | 7/1985 | Zinn et al. . |
| 4,619,601 | 10/1986 | Sumitani . |
| 4,622,003 | 11/1986 | Roth . |
| 4,637,794 | 1/1987 | Gray et al. . |
| 4,688,495 | 8/1987 | Galloway . |
| 4,695,248 | 9/1987 | Gray . |
| 4,699,588 | 10/1987 | Zinn et al. . |
| 4,701,126 | 10/1987 | Gray et al. . |
| 4,708,159 | 11/1987 | Lockwood, Jr. . |
| 4,708,635 | 11/1987 | Vishwanath . |
| 4,770,626 | 9/1988 | Zinn et al. . |
| 4,863,702 | 9/1989 | Galloway et al. . |
| 4,874,587 | 10/1989 | Galloway . |
| 4,940,405 | 7/1990 | Kelly . |
| 4,951,613 | 8/1990 | Harandi et al. . |
| 4,992,043 | 2/1991 | Lockwood, Jr. . |
| 5,059,404 | 10/1991 | Mansour et al. . |
| 5,064,811 | 11/1991 | Mansour et al. . |
| 5,092,766 | 3/1992 | Kubotani . |
| 5,136,793 | 8/1992 | Kubotani . |
| 5,197,399 | 3/1993 | Mansour . |
| 5,211,704 | 5/1993 | Mansour . |
| 5,252,061 | 10/1993 | Ozer et al. . |
| 5,255,634 | 10/1993 | Mansour . |
| 5,353,721 | 10/1994 | Mansour et al. . |
| 5,427,738 | 6/1995 | Galloway . |

FOREIGN PATENT DOCUMENTS

| | | |
|---|---|---|
| 0 529 988 A1 | 3/1993 | European Pat. Off. . |
| 1080437 | 3/1989 | Japan . |
| 81/00854 | 1/1982 | WIPO . |

*Primary Examiner*—Henry A. Bennett
*Assistant Examiner*—Steve Gravini
*Attorney, Agent, or Firm*—Dority & Manning, P.A.

[57] ABSTRACT

The present invention is directed to drying and heating processes and to an apparatus incorporating a pulse combustion device that can be used in a drying system or in a heating system. In general, the apparatus includes a pulse combustion device for the combustion of a fuel to produce a pulsating flow of combustion products and an acoustic pressure wave. The pulse combustion device has a combustion chamber connected to at least one resonance tube. A resonance chamber surrounds at least a portion of the pulse combustion device and includes a nozzle downstream from the resonance tube. The nozzle accelerates the combustion products flowing therethrough and creates a pulsating velocity head. In a drying system, the nozzle exits into a drying chamber where the combustion products contact a feed stream. When used in a heating system, on the other hand, the nozzle exits into an eductor which mixes the combustion products with a recycled stream of combustion products for forming an effluent that is fed to a heat exchanging device.

20 Claims, 4 Drawing Sheets

APPARATUS FOR DRYING AND HEATING USING A PULSE COMBUSTOR

This is a division of application Ser. No. 08/558,275 filed Nov. 13, 1995 U.S. Pat. No. 5,638,609.

BACKGROUND OF THE INVENTION

The present invention generally relates to an apparatus and processes for drying and for heating various materials. More particularly, the present invention relates to a pulse combustion apparatus and process for drying slurries and to a pulse combustion apparatus and process for providing heat to a process heater.

Pulse combustors are useful in a wide variety of applications. A pulse combustor is a device generally having a combustion chamber that is adapted to receive fuel and air. The fuel and air are mixed in the combustion chamber and periodically self-ignited to create a high energy pulsating flow of combustion products and an acoustic pressure wave. Typically, the pulse combustor also includes one or more elongated resonance tubes associated with the combustion chamber for achieving release of the hot gases from the chamber on a periodic basis. The pulsating flow of combustion products produced can be used for a variety of purposes.

For instance, the assignee of the present invention has developed a variety of systems and processes incorporating a pulse combustor. Some of these processes and systems are disclosed in U.S. Pat. No. 5,059,404 entitled "Indirectly Heated Thermochemical Reactor Apparatus And Processes," U.S. Pat. No. 5,211,704 entitled "Process And Apparatus For Heating Fluid Employing A Pulse Combustor," U.S. Pat. No. 5,255,634 entitled "Pulsed Atmospheric Fluidized Bed Combustor Apparatus," and U.S. Pat. No. 5,353,721 entitled "Pulse Combusted Acoustic Agglomeration Apparatus And Process," all of which are specifically incorporated herewith by reference thereto in their entireties.

The present invention is generally directed to an apparatus containing a pulse combustion device that can be used as part of a drying system or as part of a heating system. In a drying arrangement, a stream of materials is directly contacted with a flow of combustion products emanating from a pulse combustor. The combustion products cause moisture and any other volatile liquids to evaporate for recovering a solids product contained within the material stream. When used as a heating system, on the other hand, the combustion products originating from the pulse combustor are fed to a heat exchanger where heat transfer occurs.

In the past, others have attempted to use a pulse combustor for drying various feed streams. For instance, U.S. Pat. No. 5,252,061 to Ozer et al. discloses a pulse combustion drying system. The system includes a pulse combustor and an associated combustion chamber whereby a pulsating flow of hot gases are generated. A tailpipe is connected to the outlet of the combustion chamber, a material introduction chamber is connected at the outlet of the tailpipe, and a drying chamber is connected at the outlet of the material introduction chamber. The system further includes cooling means for controlling the temperature of the hot gases issuing from the outlet of the tailpipe.

In U.S. Pat. No. 5,092,766 to Kubotani, a pulse combustion method and pulse combustor are disclosed. The pulse combustor includes a combustion chamber, an air intake with an open end, an exhaust pipe, and a fuel port and an ignition means. The pulse combustor further includes a compressed gas supplying means disposed at a position opposing to the open end of the air intake so that a stream of compressed gas jetted from the gas supplying means is blown into the combustion chamber through the open end of the air intake. A heat insulating cover encloses the pulse combustor so as to form an annular space between them, which receives a part of the compressed gas jetted from the compressed gas supplying means.

A pulse combustion energy system is disclosed in U.S. Pat. No. 4,992,043 to Lockwood, Jr. The system functions to recover a solid material which has been in suspension or solution in a fluid. In one embodiment, a pulse combustor is coupled to a processing tube which in turn is coupled to a pair of cyclone collectors. Material to be processed is fed into an upstream end of the processing tube and the resulting processed material is removed from the combustion stream by the cyclone collectors.

Other prior art references directed to drying systems using pulse combustors include U.S. Pat. No. 5,136,793 to Kubotani, U.S. Pat. No. 4,701,126 to Gray et al., U.S. Pat. No. 4,695,248 to Gray, and U.S. Pat. No. 4,637,794 to Gray et al.

Although the prior art discloses various systems and processes incorporating a pulse combustor, various features and aspects of the present invention remain absent. In particular, the present invention provides further advancements and improvements in pulse combustion heating and drying systems.

SUMMARY OF THE INVENTION

The present invention recognizes and addresses various limitations of prior art constructions and methods.

Accordingly, it is an object of the present invention to provide a drying system and a heating system incorporating a pulse combustion device.

It is another object of the present invention to provide a pulse combustion apparatus for drying a solid material contained within a slurry.

Still another object of the present invention is to provide a method of drying a solid material contained within a fluid stream using a pulsating flow of combustion products.

Another object of the present invention is to provide a pulse combustion apparatus for supplying heat to a heat exchanging device.

It is another object of the present invention to provide a method for supplying heat to a process heater using a pulse combustor.

These and other objects of the present invention are achieved by providing a pulsating apparatus for drying material and for providing process heat. The apparatus includes a pulse combustion device for the combustion of a fuel to produce a pulsating flow of combustion products and an acoustic pressure wave. The pulse combustion device includes a combustion chamber and at least one resonance tube. The resonance tube has an inlet in communication with the pulse combustion chamber.

A resonance chamber surrounds at least a portion of the resonance tube and is coupled therewith in a manner such that a standing wave is created in the resonance chamber. The resonance chamber has a first closed end and a second open end where at least one nozzle is positioned. The nozzle is in fluid communication with the outlet of the resonance tube and is spaced downstream therefrom. The nozzle accelerates the pulsating combustion products flowing therethrough and creates a pulsating velocity flow field adapted to heat and dry materials.

When drying materials, the apparatus can include a drying chamber in communication with the nozzle. The drying chamber includes a materials introduction port for introducing a stream of materials into the drying chamber proximate to the nozzle. The introduction port is positioned so that the stream of materials contacts the pulsating flow of combustion products exiting the nozzle and mixes with the combustion products for effecting heat transfer therebetween.

In one embodiment, the drying chamber can be shaped to conform to the outer boundaries of a spray of the combustion products emitted by the nozzle. The apparatus can also include a particle separation device, such as a baghouse, for removing and recovering a dried product from the resulting gas stream.

The pulse combustion device used in the apparatus can produce an acoustic pressure wave at a sound pressure level in a range from about 161 dB to about 194 dB and at a frequency in a range of from about 50 Hz to about 500 Hz. The nozzle can be configured with the pulse combustion device to release the pulsating flow of combustion products at a minimum velocity of at least about 30 feet per second and in most applications at least about 100 feet per second.

When the pulsating apparatus is used for heating, the apparatus can include a recirculation conduit having first and second ends. The first end of the conduit can be adapted to be in communication with an outlet of a heat exchanging device. An eductor can be provided having an entrance in communication with the nozzle and with the second end of the recirculation conduit. The eductor mixes the pulsating flow of combustion products emitted from the pulse combustion device with a recycled stream of combustion products exiting the heat exchanging device. The resulting mixture or effluent can be directed into the heat exchanging device for providing heat thereto.

In one embodiment, the eductor can be a venturi. The recirculation conduit can include a recirculation chamber concentric with the resonance chamber. A passage defined between the resonance chamber and the recirculation chamber can receive the recycled stream of combustion products exiting the heat exchanging device for entry into the eductor.

When used as a heater, the pulsating flow of combustion products can have a temperature of from about 1,000° F. to about 3,000° F. when exiting the resonance chamber. The pulse combustion device can produce an acoustic pressure wave at a sound pressure level in a range from about 161 dB to about 194 dB and at a frequency in a range of from about 50 Hz to about 500 Hz.

The present invention is also directed to a process for drying a stream of materials containing solid particles. The process includes the steps of generating a pulsating flow of combustion products and an acoustic pressure wave. The pulsating flow of combustion products is accelerated to create a high velocity pulsating flow field. The high velocity flow field is contacted with a fluid containing solid particles causing the fluid to atomize and to mix with the combustion products. The combustion products thus transfer heat to the atomized fluid for drying the solid particles contained therein.

The temperature of the combustion products prior to contacting the fluid can be in the range of from about 800° F. to about 2,200° F. The combustion products, when accelerated, can have a mean velocity of about 200 to about 300 feet per second, with a minimum velocity of at least about 100 feet per second to about 150 feet per second. The acoustic pressure wave created can have a sound pressure level in a range from about 161 dB to about 194 dB and a frequency in a range of from about 50 Hz to about 500 Hz.

The present invention is also directed to a process for providing heat to a heat exchanging device. The process includes the steps of generating a pulsating flow of combustion products and an acoustic pressure wave. The pulsating flow of combustion products are accelerated to create a pulsating velocity flow field. The accelerated flow of combustion products is supplied to a heat exchanging device for transferring heat thereto.

At least a portion of the combustion products exiting the heat exchanging device are recirculated to produce a recycle stream. The recycle stream is mixed with the pulsating flow of combustion products to form an effluent that is fed to the heat exchanging device. A pressure differential can be maintained between the pulsating flow of combustion products and the recycle stream prior to mixing. The pressure differential creates a suction force for automatically siphoning the recycle stream exiting the heat exchanging device into contact with the pulsating flow of combustion products.

The temperature of the combustion products prior to mixing with the recycle stream can be between about 1,000° F. and about 3,000° F. The acoustic pressure wave can be at a sound pressure level in a range from about 161 dB to about 194 dB and at a frequency within the range from about 50 Hz to about 500 Hz.

Other objects, features and aspects of the present invention are discussed in greater detail below.

BRIEF DESCRIPTION OF THE DRAWINGS

A full and enabling disclosure of the present invention including the best mode thereof, to one of ordinary skill in the art, is set forth more particularly in the remainder of the specification, including reference to the accompanying figures in which.

Figure 1:
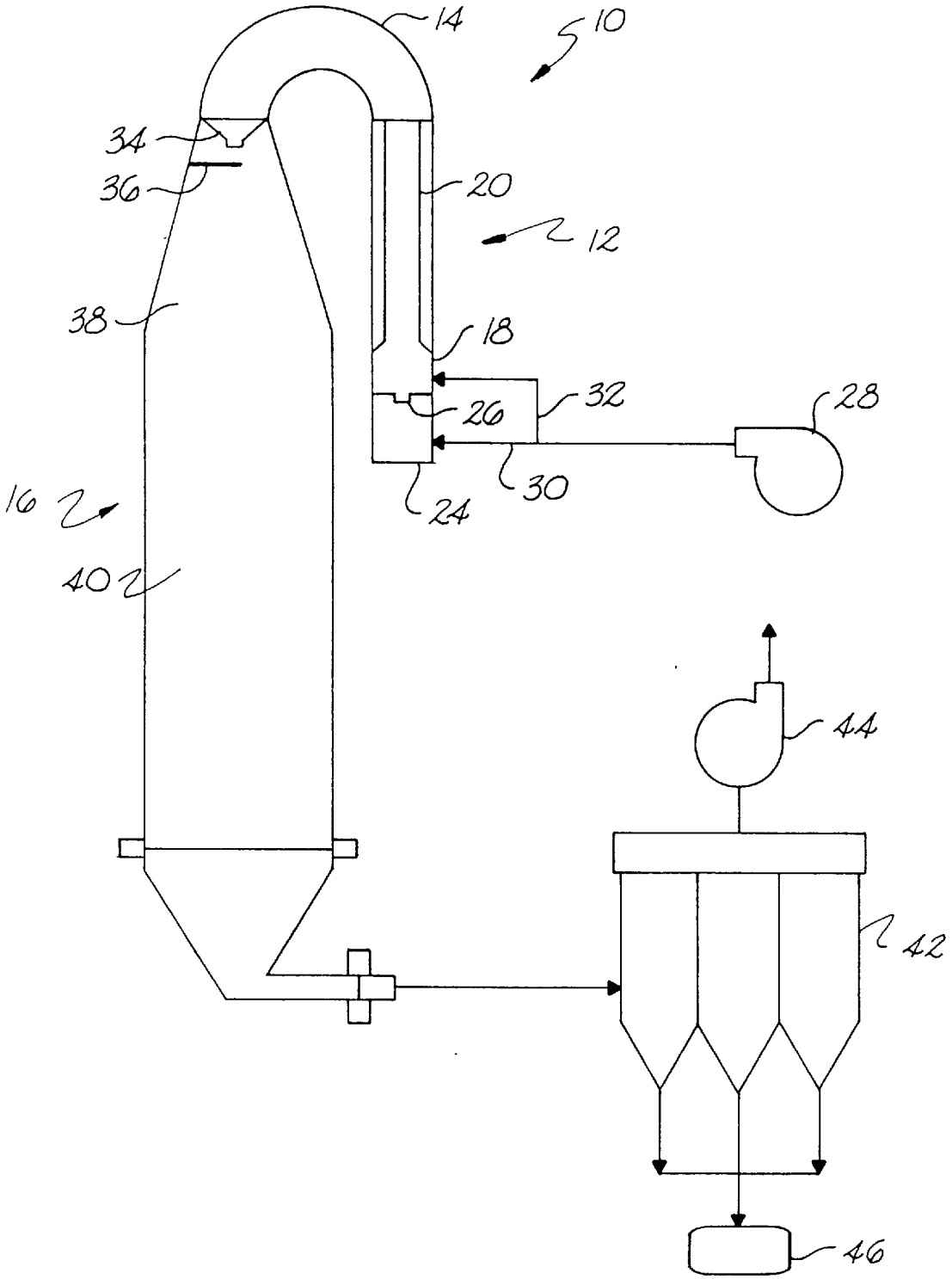
FIG. 1 is a cross sectional view of one embodiment of a drying system made in accordance with the present invention.

Repeat use of reference characters in the present specification and drawings is intended to represent same or analogous features or elements of the invention.

DETAILED DESCRIPTION OF PREFERRED EMBODIMENTS

It is to be understood by one of ordinary skill in the art that the present discussion is a description of exemplary embodiments only, and is not intended as limiting the broader aspects of the present invention, which broader aspects are embodied in the exemplary construction.

In general, the present invention is directed to an apparatus and to processes for drying solid particles and for providing process heat. A pulse combustion device is incorporated into the apparatus which provides enhanced heat and mass transfer rates. The pulse combustion device, as opposed to conventional burners, generates a relatively clean flue gas for drying and has relatively low fuel requirements when used as a heater.

When incorporated into a drying system, the pulse combustion device generates a pulsating flow of combustion products that are directly contacted with a slurry, which is defined herein as a fluid containing solid particles. Through the particular arrangement of the present invention, the slurry is atomized by the combustion products without using conventional high shear nozzle atomizers. After the slurry is atomized, water and/or other volatile liquids are evaporated from the solid particles. The resulting product stream is then fed to a solids collection device for recovering the solid particles.

When the apparatus of the present invention is incorporated into a heating system, the pulse combustion device generates a pulsating flow of combustion products that are fed to a process heater. In the process heater, heat exchange occurs between the combustion products and any material, feed stream, or fluid that needs to be heated. According to the present invention, at least a portion of the combustion products exiting the process heater are recycled back to the apparatus. Specifically, the apparatus can include an eductor for mixing the pulsating flow of combustion products with the recycled stream exiting the process heater.

Figure 2:
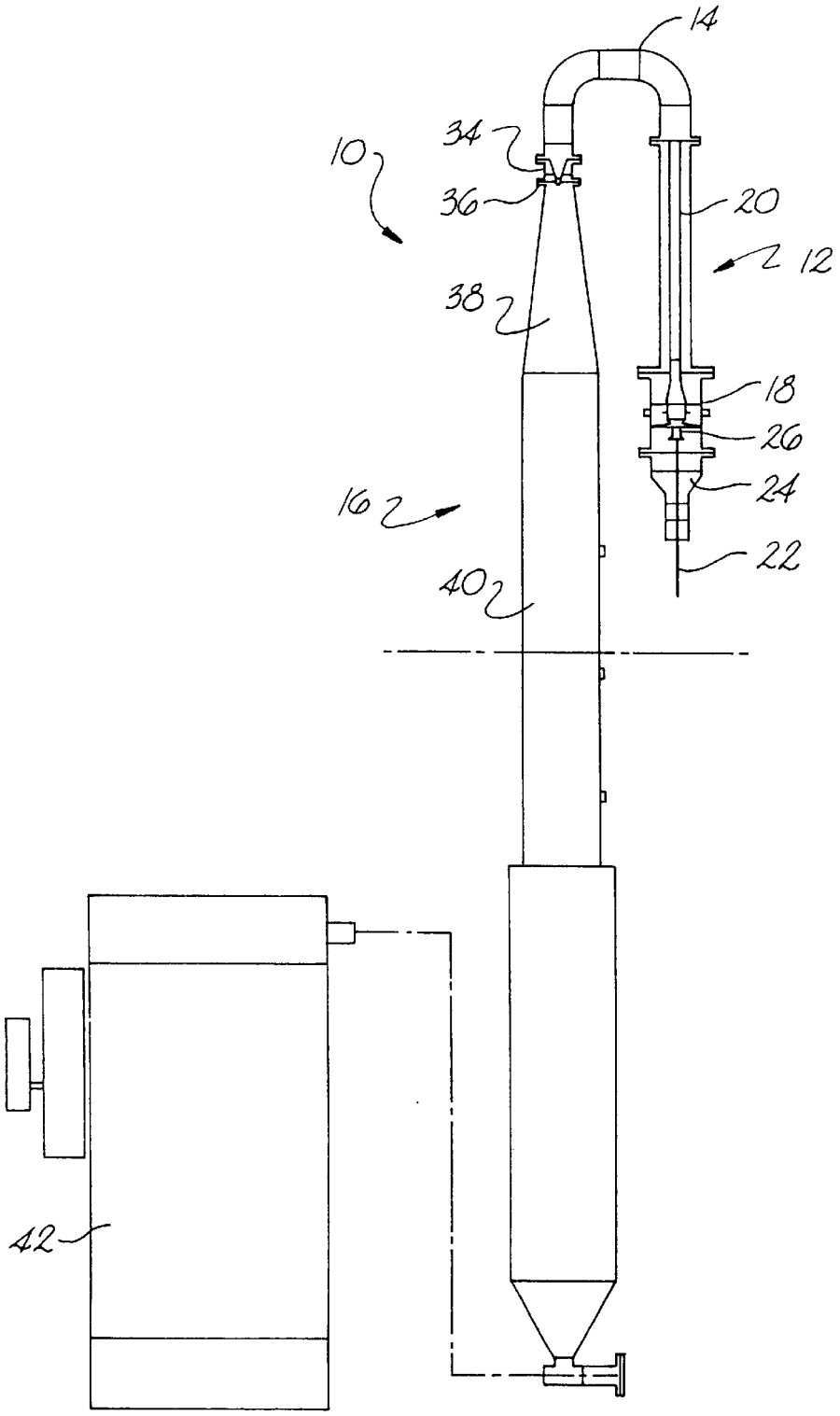
FIG. 2 is a cross sectional view of the embodiment illustrated in FIG. 1.

Referring to FIGS. 1 and 2, one embodiment of a drying system generally 10 according to the present invention is illustrated. Drying system 10 includes a pulse combustion device generally 12 in communication with a resonance chamber 14, which is connected to a drying chamber generally 16.

As more particularly shown in FIG. 2, pulse combustion device 12 includes a combustion chamber 18 in communication with a resonance tube or tailpipe 20. Combustion chamber 18 can be connected to a single resonance tube as shown in the figures or a plurality of parallel tubes having inlets in separate communication with the pulse combustion chamber. Fuel and air are fed to combustion chamber 18 via a fuel line 22 and an air plenum 24. Pulse combustion device 12 can burn either a gaseous, a liquid or a solid fuel. When used to dry a slurry, a gas or liquid fuel can be used so that the combustion products exiting the combustion chamber do not contain particulate matter. For instance, pulse combustion device 12 can be fueled by natural gas.

In order to regulate the amount of fuel and air fed to combustion chamber 18, pulse combustion device 12 can include at least one valve 26. Valve 26 is preferably an aerodynamic valve, though a mechanical valve or the like may also be employed.

During operation of pulse combustion device 12, an appropriate fuel and air mixture passes through valve 26 into combustion chamber 18 and is detonated. During start-up, an auxiliary firing device such as a spark plug or pilot burner is provided. Explosion of the fuel mixture causes a sudden increase in volume and evolution of combustion products which pressurizes the combustion chamber. As the hot gas expands, preferential flow in the direction of resonance tube 20 is achieved with significant momentum. A vacuum is then created in combustion chamber 18 due to the inertia of the gases within resonance tube 20. Only a small fraction of exhaust gases are then permitted to return to the combustion chamber, with the balance of the gas exiting the resonance tube. Because the pressure of combustion chamber 18 is then below atmospheric pressure, further air-fuel mixture is drawn into combustion chamber 18 and auto-ignition takes place. Again, valve 26 thereafter constrains reverse flow, and the cycle begins anew. Once the first cycle is initiated, operation is thereafter self-sustaining.

As stated above, although a mechanical valve may be used in conjunction with the present system, an aerodynamic valve without moving parts is preferred. With aerodynamic valves, during the exhaust stroke, a boundary layer builds in the valve and turbulent eddies choke off much of the reverse flow. Moreover, the exhaust gases are of a much higher temperature than the inlet gases. Accordingly, the viscosity of the gas is much higher and the reverse resistance of the inlet diameter, in turn, is much higher than that for forward flow through the same opening. Such phenomena, along with the high inertia of exhausting gases in resonance tube 20, combine to yield preferential and mean flow from inlet to exhaust. Thus, the preferred pulse combustor is a self-aspirating engine, drawing its own air and fuel into the combustion chamber followed by auto-ignition.

Pulse combustor systems as described above regulate their own stoichiometry within their ranges of firing without the need for extensive controls to regulate the fuel feed to combustion air mass flow rate ratio. As the fuel feed rate is increased, the strength of the pressure pulsations in the combustion chamber increases, which in turn increases the amount of air aspirated by the aerodynamic valve, thus allowing the combustor to automatically maintain a substantially constant stoichiometry over its designed firing range. The induced stoichiometry can be changed by modifying the aerodynamic valve fluidic diodicity.

Pulse combustion device 12 produces a pulsating flow of combustion products and an acoustic pressure wave. In one embodiment, the pulse combustion device of the present invention as used in drying system 10 produces pressure oscillations or fluctuations in the range of from about 1 psi to about 40 psi and particularly between about 1 psi and 25 psi peak to peak. These fluctuations are substantially sinusoidal. These pressure fluctuation levels are on the order of a sound pressure range of from about 161 dB to about 194 dB and particularly between about 161 dB and 190 dB. The acoustic field frequency range depends primarily on the combustor design and is only limited by the fuel flammability characteristics. Generally, pulse combustion device 12 as used in drying system 10 will have an acoustic pressure wave frequency of from about 50 to about 500 Hz and particularly between 100 Hz and 300 Hz.

In one embodiment, pulse combustion device 12 is cooled externally by a shroud of tempering air or, alternatively, by cooling water using a water jacket. As shown in FIG. 1, drying system 10 includes a forced draft fan 28 which provides combustion air to combustion chamber 18 through conduit 30 and cooling air to pulse combustion device 12 through conduit 32. In an alternative embodiment, instead of using a cooling fluid, pulse combustion device 12 can be refractory-lined. Generally, the temperature of the combustion products exiting the resonance tube 20 will range from about 1,600° F. to 2,500° F.

Pulse combustion device 12 is coupled with resonance chamber 14. Resonance chamber 14 is closed at one end adjacent pulse combustion device 12 and is open at an opposite end where at least one nozzle 34 is positioned. Resonance chamber 14 can be curved as shown in FIGS. 1 and 2 or can be straight. In the embodiment illustrated, resonance chamber 14 is curved so as to conserve space. The curve will preferably be 180° or 90°, as appropriate.

Resonance chamber 14 is in communication with resonance tube 20 for receiving the pulsating flow of combustion products emanating from combustion chamber 18. Resonance chamber 14 is designed to minimize acoustic losses and to maximize the pressure fluctuations of the combustion products at the entrance to nozzle 34. The integration of resonance chamber 14 with pulse combustion device 12 also aids in tempering the flue gas stream.

The shape and dimensions of resonance chamber 14 will depend upon process conditions. In order to minimize acoustic losses, resonance chamber 14 should be coupled with resonance tube 20 in a manner so that a standing wave is created in the resonance chamber. Also, in order to maximize pressure fluctuations at the entrance to nozzle 34, resonance chamber 14 should be designed to create a pressure antinode at the entrance to nozzle 34. For instance, resonance chamber 14 can completely enclose resonance tube 20 or can be made to only cover a portion of the resonance tube. Generally speaking, the higher the temperature surrounding resonance tube 20 during operation, the greater the extent resonance chamber 14 should enclose resonance tube 20, which is based on the effect temperature has on sound wave transmission. The ends of the resonance chamber 14 act as pressure antinodes and the section corresponding to the resonance tube exit operates as a velocity antinode/pressure node to yield matched boundary conditions which minimize sound attenuation.

Nozzle 34 located at the downstream end of resonance chamber 14 is designed to translate the static head of the pulsating flow of combustion products into a velocity head. Nozzle 34 accelerates the flow of the combustion products and creates velocity fluctuations. This pulsating velocity flow field not only provides high mass transfer and heat transfer rates but also can be used to atomize the fluid stream being dried. As used herein, atomization refers to a process by which a fluid is converted into liquid droplets.

The temperature of the combustion products exiting resonance chamber 14 can be varied depending upon the heat sensitivity of the materials being dried in the system, the slurry properties and possibly other considerations. The operating temperature of the pulse combustion device can be controlled by controlling the fuel and combustion air flow rates. In most applications, preferably the temperature of the combustion products exiting the nozzle 34 are within the range from about 800° F. to about 2,200° F. and more particularly from about 1,200° F. to about 1,800° F.

In fluid communication with nozzle 34 is drying chamber 16 which includes a fluid stream introduction port or ports 36 spaced downstream and in close proximity to nozzle 34. According to the present invention, a stream of materials or a slurry can be introduced into drying chamber 16 through port 36 and contacted with a pulsating flow of combustion products exiting nozzle 34. The combustion products, which have a velocity fluctuating profile, mix with and atomize the feed materials. Thus, conventional atomizing devices and spray heads are not required in the present invention to introduce a slurry into the system. All that is required is a feed pipe that introduces the feed materials in close proximity to nozzle 34.

The pulsating velocity of the combustion products exiting nozzle 34 should be sufficient to atomize the feed stream that is fed to drying chamber 16. This velocity profile will depend upon the feed materials, the solid particles being dried and other process conditions. For most applications, the mean velocity of the combustion products exiting nozzle 34 should be between about 200 feet per second to about 1,200 feet per second. During pulsations, the minimum velocity of the combustion products should be at least about 30 feet per second to about 600 feet per second.

Once atomized, the feed materials flow through drying chamber 16. In drying chamber 16, solid particles contained within the feedstock are dried by evaporating water and other volatile liquids therefrom. Drying chamber 16 should have a length that provides a retention time sufficient to dry the solid particles to a desired level. In general, drying chamber 16 should operate at slightly below atmospheric pressure to prevent the possibility of material leakage to outside.

In one embodiment of the present invention, as shown in FIGS. 1 and 2, drying chamber 16 can include two sections: a first conical section 38 and a second section 40. Conical section 38 is intended to conform to the shape of the spray of combustion products exiting nozzle 34. More particularly, the shape of section 38 should be slightly larger than the maximum extent of the spray exiting nozzle 34. In this arrangement, the atomized feed stream is prevented from contacting the walls of drying chamber 16, while minimizing the size of drying chamber 16. Also recirculation of dried material is minimized. It is generally desirable to have as little contact as possible between the walls of the drying chamber and the material being dried. This prevents particles in the feed stream from sticking to the walls and maximizes contact and mixing between the feed stream and the combustion products generated by the pulse combustion device.

The product stream exiting drying chamber 16, which contains evaporated liquids, dried particles and the combustion products from the pulse combustion device, can then be fed to a particle separation device 42 for capturing the dried solid material. The temperature of the combustion products and particulates entering the particle separation device will generally be in the 150° F. to 300° F. range and will exceed the dew point temperature. Particle separation device 42 can include a cyclone, a baghouse, other high efficiency filters, or a series of different collection devices. In one embodiment, as shown in FIG. 1, a baghouse 42 is used in which the solid particles are collected into a collection bunker 46. An induced draft fan 44 is used to maintain negative pressure on baghouse 42 for preventing material leakage from the system.

Once the solid particles are removed from the product stream exiting drying chamber 16, the remaining gas stream can be recycled, used in other processes, or vented to the atmosphere. In one embodiment, the gas stream, after exiting the particle separation device, can be sent to a condenser for recovering any solvents or liquids contained within the gas stream. The collected fluids can then be used and recycled.

The process by which drying system 10 can be used to dry a feed stream will now be discussed. As described above, pulse combustion device 12, through combustion of a fuel, generates a pulsating flow of combustion products and an acoustic pressure wave. The combustion products exit resonance tube 20 and enter resonance chamber 14, which is designed to minimize acoustic losses and to create a pressure antinode at the entrance to nozzle 34. Nozzle 34 accelerates the combustion products translating the oscillating pressure head into an oscillating velocity head.

A feed stream, such as a slurry, is introduced into drying chamber 16 and contacted with the combustion products exiting nozzle 34, causing the feed stream to atomize. Once atomized, heat transfer takes place between the combustion products and the feed stream, which is enhanced by the acoustic wave generated by the pulse combustion device. Solid particles contained within the feed stream are thus dried by evaporating any liquids in contact with the particles. The dried particles can then be separated from the gas stream and recovered. Generally, the dried material is free-flowing and is of superior quality due to drying uniformity.

Generally, the apparatus of the present invention when used to dry a feed stream, first atomizes the feed stream using velocity fluctuations created by nozzle 34 and then efficiently dries the solid particles contained within the feed stream using the acoustic wave generated by the pulse combustion device. More particularly, the acoustics generated by the pulse combustion device enhances heat and mass transfer rates thereby aiding faster and more uniform drying and results in superior product quality. Also, the drying effectiveness is improved which reduces the air and fuel requirements and in turn the operational costs of the system.

Drying system 10 as shown in FIGS. 1 and 2 can be used for a variety of purposes. In general, this system can be used not only to dry and recover solid materials but can also be used to reduce the volume and amount of various wastes prior to disposal. Particular materials that can be processed according to the present invention are listed below. The following list, however, is merely exemplary and is not exhaustive.

| | |
|---|---|
| Chemicals: | catalysts, fertilizers, detergents, resins, herbicides, pesticides, fungicides, pigments, etc. |
| Minerals: | ores, silica gel, carbides, oxides, ferrites, etc. |
| Plastics: | polymers, PVC, etc. |
| Food products: | proteins, corn syrup, gluten, seasonings, starch, eggs, yeast, dextrose, juices, teas, coffees, milk, whey, etc. |
| Pharmaceuticals: | cellulose, antibiotics, blood, vitamins, etc. |
| Industrial Wastes: | spent liquors, solvents, sludges, waste water, etc. |

Figure 3:
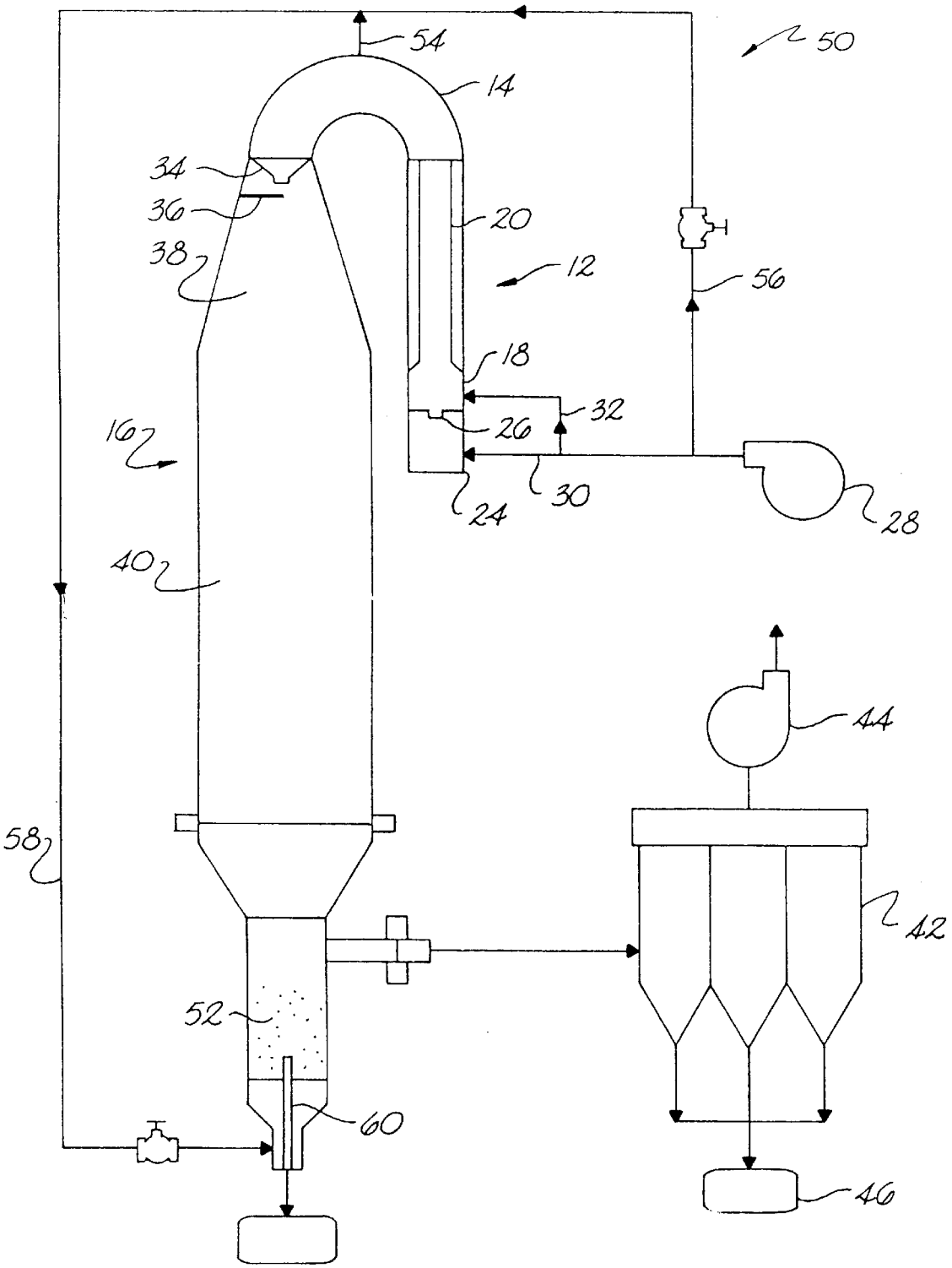
FIG. 3 is a cross sectional view of another embodiment of a drying system made in accordance with the present invention.

Referring to FIG. 3, an alternative embodiment of a drying system, generally 50, in accordance with the present invention is illustrated. For simplicity, like numbered members appearing in FIGS. 1, 2 and 3 indicate like elements. As opposed to the embodiment illustrated in FIGS. 1 and 2, drying system 50 is not only for drying solid particles but is also for agglomerating at least a portion of the solid particles. The particles can be agglomerated in order to meet process needs or to facilitate and to increase the efficiency of removal of the particles from the product gas stream.

As shown in FIG. 3, drying system 50 includes a pulse combustion device generally 12 having a combustion chamber 18 and at least one resonance tube 20. Pulse combustion device 12 is in communication with a resonance chamber 14 which has at least one nozzle 34 positioned on the downstream end. Nozzle 34 exits into a drying chamber generally 16 which includes an expanding section 38 having a conformation designed to match the outer boundaries of a spray emitted from nozzle 34.

In this embodiment, in order to promote agglomeration, the flow rate of the combustion products being emitted from nozzle 34 is reduced. A feed stream fed to drying chamber 16 through port 36 is then atomized by nozzle 34 into larger droplets. The larger droplets will thus contain larger and more solid particles. Larger droplets, however, will require a longer residence time to dry. Consequently, drying system 50 includes a fluidized bed 52 connected to drying chamber 16 for drying the larger particles. Smaller particles produced during this process, due to having a lighter weight, will bypass fluidized bed 52 and proceed to baghouse 42 for ultimate collection if desired.

The fluidizing medium fed to fluidized bed 52, in this embodiment, is a mixture of air supplied by fan 28 through a conduit 56 and combustion products emanating from pulse combustion device 12 through conduit 54. Specifically, the combustion products are drawn off resonance chamber 14, mixed with the air and fed to fluidized bed 52 through conduit 58. The temperature of the gaseous mixture entering the fluidized bed will generally be in the 400° F. to 1,000° F. range. By drawing off combustion products from resonance chamber 14, not only is heat being supplied to fluidized bed 52 for drying the larger particles, but the fluid flow rate through nozzle 34 is reduced.

The volumetric flow rate of gas fed to fluidized bed 52 should be controlled so that sufficient drying takes place in the bed without the particles entering the bed being forced back into drying chamber 16. Ultimately, the particles entering bed 52 are dried and collected through collection tube 60.

The drying and agglomeration process occurring in drying system 50 begins with pulse combustion device 12 generating a pulsating flow of combustion products and an acoustic pressure wave. The combustion products enter resonance chamber 14, where a portion enters conduit 54 and the remainder is emitted from nozzle 34.

A feed stream entering drying chamber 16 through port 36 is contacted with the combustion products emitted from nozzle 34. This collision causes the feed stream to be atomized into droplets of varying size, wherein the larger droplets contain correspondingly more solid particles. As the atomized feed stream flows through drying chamber 16, the droplets are at least surface-dried and may be partially dried internally.

The smaller particles produced during the process bypass fluidized bed 52 and enter particle separation device 42 where they can be ultimately collected in bunker 46. The larger particles or agglomerates, on the other hand, enter fluidized bed 52. In the bed, the agglomerates are further dried by a fluid stream containing a mixture of air and combustion products drawn off resonance chamber 14. Once dried, the agglomerates or larger particles are collected through collection tube 60.

The particular configuration of the present invention is not only well adapted to drying systems but can also be used to provide heat to a heat exchanging device or to any suitable process heater. For instance, referring to FIG. 4, one embodiment of a heating system generally 70 according to the present invention is illustrated. The system can operate at atmospheric pressure or at an elevated pressure. Again, like numbered members appearing in FIGS. 1 through 4 are intended to represent like elements.

Similar to the drying system illustrated in FIGS. 1 and 2, heating system 70 includes a pulse combustion device 12 having a combustion chamber 18 and a resonance tube 20. Combustion chamber 18 is fed a gaseous, liquid or solid fuel through fuel line 22 and air through air plenum 24 via aerodynamic valve 26. Air is supplied to air plenum 24 through feed air conduit 30.

In this embodiment, pulse combustion device 12 is cooled by cooling air which is supplied through conduit 32. Air entering conduit 32 blankets combustion chamber 18 and resonance tube 20.

At least a portion of combustion device 12 is contained within a resonance chamber 14. The resonance chamber is designed to minimize acoustic losses and to maximize pressure fluctuations at the entrance to a nozzle 34. Nozzle 34 translates the static head produced by pulse combustion device 12 to velocity head.

Figure 4:
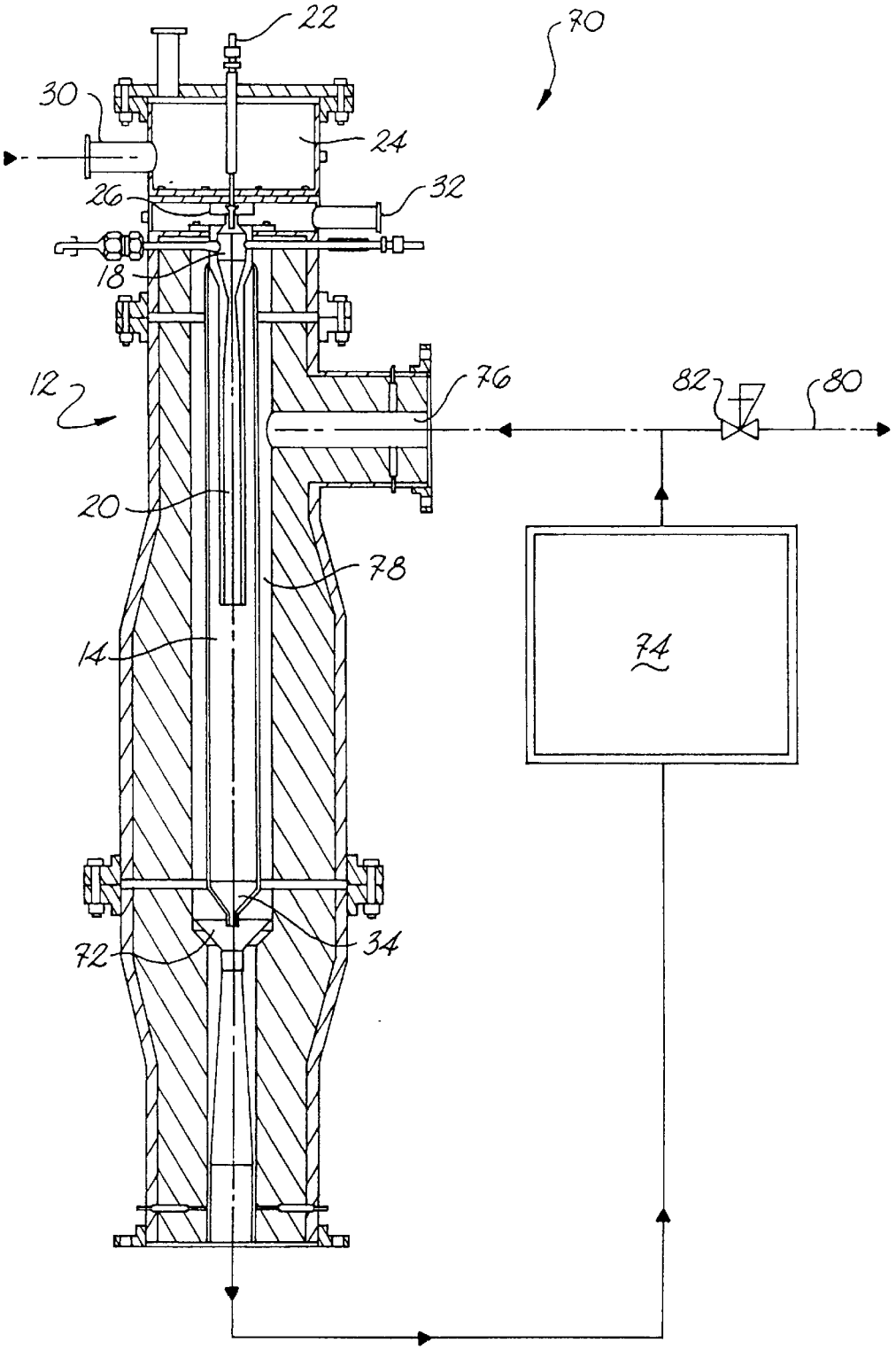
FIG. 4 is a cross sectional view of one embodiment of a heating system made in accordance with the present invention.

According to the embodiment illustrated in FIG. 4, resonance chamber 14 is in communication with an eductor 72 which directs the combustion products flowing through the apparatus into a process heater or heat exchanging device 74. In heat exchanging device 74, heat transfer takes place between the stream of combustion products and the material or materials that are being heated indirectly or directly.

In order to maximize energy and heat transfer efficiency, heating system 70 recycles at least a portion of the combustion products exiting heat exchanging device 74. In particular, at least a portion of the combustion products exiting heat exchanging device 74 enter a recirculation conduit 76 which is in communication with a recirculation chamber 78 that, in this embodiment, surrounds resonance chamber 14. Recirculation chamber 78 empties into eductor 72 which mixes the recycled stream of combustion products with combustion products being emitted from pulse combustion device 12.

During the operation of heating system 70, pulse combustion device 12 generates a pulsating flow of combustion products and an acoustic pressure wave which are transferred into resonance chamber 14. The combustion products enter nozzle 34 and are accelerated creating a pulsating velocity head.

Pulse combustion device 12, in this embodiment, can operate at a variety of different ranges and under different conditions. In one embodiment, pulse combustion device 12 generates pressure oscillations in the range of from about 1 psi to about 40 psi peak to peak. The pressure fluctuations are on the order of about 161 dB to about 194 dB in sound pressure level. The acoustic field frequency range can be between about 50 to about 500 Hz. The temperature of the combustion products exiting resonance tube 20 can also be varied depending upon process demands and can, for instance, be within the range from about 1,000° F. to about 3,000° F.

From nozzle 34, the combustion products enter eductor 72 where they are mixed with a recycled stream of combustion products that have exited heat exchanging device 74. Nozzle 34 provides the motive fluid flow and momentum for inducing flow in conjunction with eductor 72. Eductor 72, which in this embodiment is in the shape of a venturi, facilitates the mixing of the two streams and serves to boost the pressure of the recycled stream. The mixture of gaseous products are then fed to heat exchanging device 74 for transferring heat as desired.

During the operation of heating system 70, the pressure in the pulse combustion device-resonance chamber combination can be higher than the pressure in heat exchanging device 74. The nozzle exit flow creates a suction force at eductor 72 that draws in combustion products exiting heat exchanging device 74 into recirculation conduit 76. The amount of this suction force can determine the amount of combustion products that are recycled and mixed with the flue gas stream exiting resonance chamber 14. The portion of the gas stream that is not recycled, as shown, is released through exit conduit 80 which includes a pressure let down valve 82 for throttling the gas stream to ambient pressure.

Heating system 70 offers many advantages and benefits over prior art systems. Particularly, heat transfer is maximized while heat input into the system is minimized. Specifically, heating system 70 includes a recycle stream for minimizing heat requirements. The recycle stream is fed to the system without utilizing any mechanical means. Pulse combustion device 12 provides a flow of high energy combustion products and an acoustic wave. The acoustic wave enhances heat transfer in heat exchanging device 74, which reduces the required heat exchange area and enhances process stream throughput.

Similar to the drying system described above, heating system 70 can be used for a variety of applications. For example, heating system 70 can provide heat for the calcination of minerals, for heat treating plastics and glass, and for non-mechanical flue gas or vapor recirculation and heating for petrochemical and process plants, boilers and furnaces. The heat generated by heating system 70 can also be used for baking, canning, textile manufacturing, etc. Of course, the above list is merely exemplary and does not begin to cover all the applications in which heating system 70 may be used.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A pulsating apparatus for drying material and for providing process heat, said apparatus comprising:

a pulse combustion device for the combustion of a fuel to produce a pulsating flow of combustion products and an acoustic pressure wave, said pulse combustion device including a combustion chamber and at least one resonance tube, said at least one resonance tube having an inlet in communication with said pulse combustion chamber, and an outlet;

a resonance chamber surrounding at least a portion of said at least one resonance tube, and coupled therewith in a manner such that a standing wave is created in said resonance chamber, said resonance chamber having a first closed end and a second open end, said resonance chamber including at least one nozzle defining said second open end, said nozzle being in fluid communication with said outlet of said resonance tube and being spaced downstream therefrom, said nozzle for accelerating said pulsating combustion products flowing therethrough for creating a pulsating velocity flow field adapted to heat and dry materials; and a materials introduction port for introducing a stream of materials to be dried, said introduction port being positioned proximate to said at least one nozzle so that said stream of materials contacts said pulsating flow of combustion products exiting said at least one nozzle.

2. A pulsating apparatus as defined in claim 1, further comprising a drying chamber in communication with said at least one nozzle, said drying chamber including said materials introduction port.

3. A pulsating apparatus as defined in claim 2, wherein said drying chamber includes an expanding conical section adjacent said at least one nozzle, said conical section being configured to match the shape of a spray of said pulsating flow of combustion products exiting said at least one nozzle.

4. A pulsating apparatus as defined in claim 2, further comprising a particulate removal device in communication with said drying chamber.

5. A pulsating apparatus for providing process heat, said apparatus comprising:

a pulse combustion device for the combustion of a fuel to produce a pulsating flow of combustion products and an acoustic pressure wave, said pulse combustion device including a combustion chamber and at least one resonance tube, said at least one resonance tube having an inlet in communication with said pulse combustion chamber, and an outlet;

a resonance chamber surrounding at least a portion of said at least one resonance tube, and coupled therewith in a manner such that a standing wave is created in said resonance chamber, said resonance chamber having a first closed end and a second open end, said resonance chamber including at least one nozzle defining said second open end, said nozzle being in fluid communication with said outlet of said resonance tube and being spaced downstream therefrom, said nozzle for accelerating said pulsating combustion products flowing therethrough for creating a pulsating velocity flow field adapted to heat and dry materials; and a recirculation conduit adapted to be in communication with an outlet of a heat exchanging device, and an eductor having an entrance in communication with said at least one nozzle and with said recirculation conduit, wherein said eductor mixes said pulsating flow of combustion products emitted from said pulse combustion device with a recycled stream of combustion products exiting said heat exchanging device to form an effluent, said effluent being fed to said heat exchanging device for providing heat thereto.

6. A pulsating apparatus as defined in claim 5, wherein said recirculation conduit includes a recirculation chamber in communication with said eductor, said recirculation chamber surrounding said resonance chamber and defining a space therebetween for the passage of said recycled stream of combustion products exiting said heat exchanging device.

7. An apparatus for drying a stream of materials, said apparatus comprising:

an enclosed resonance chamber having an open end;

a pulse combustion device for the combustion of a fuel to produce a pulsating flow of combustion products and an acoustic pressure wave, said pulse combustion device including a combustion chamber and at least one resonance tube having an inlet in communication with said pulse combustion chamber, at least a portion of said resonance tube being contained within said resonance chamber;

at least one nozzle located at said open end of said resonance chamber in communication with said at least one resonance tube, said nozzle for accelerating said pulsating combustion products flowing therethrough and for creating a pulsating velocity flow field; and a drying chamber in communication with said at least one nozzle, said drying chamber including a materials introduction port for introducing a stream of materials into said drying chamber proximate to said at least one nozzle, said introduction port being positioned so that said stream of materials contacts said pulsating flow of combustion products exiting said at least one nozzle and mixes with said combustion products for effecting heat transfer therebetween.

8. An apparatus as defined in claim 7, wherein said drying chamber has a shape that conforms to the outer boundaries of a spray of said combustion products emitted by said at least one nozzle.

9. An apparatus as defined in claim 7, wherein said pulse combustion device produces said acoustic pressure wave at a sound pressure level in a range from about 161 dB to about 194 dB and at a frequency in a range of from about 50 Hz to about 500 Hz.

10. An apparatus as defined in claim 7, wherein at least one nozzle is configured to release said pulsating flow of combustion products at a velocity of at least about 30 feet per second.

11. An apparatus as defined in claim 8, wherein said shape of said drying chamber comprises a first section having an expanding conical conformation configured to match the shape of said spray of said pulsating flow of combustion products exiting said at least one nozzle.

12. An apparatus as defined in claim 7, wherein said pulse combustion device includes a plurality of parallel resonance tubes having inlets in separate communication with said pulse combustion chamber.

13. An apparatus as defined in claim 7, further comprising a particulate removal device in communication with said drying chamber.

14. An apparatus as defined in claim 7, wherein said resonance chamber is coupled with said at least one resonance tube in a manner such that a standing wave is created in said resonance chamber.

15. A pulsating apparatus for providing heat to a heat exchanging device, said apparatus comprising:

an enclosed resonance chamber having an open end;

a pulse combustion device for the combustion of a fuel to produce a pulsating flow of combustion products and an acoustic pressure wave, said pulse combustion device including a combustion chamber and at least one resonance tube having an inlet in communication with said pulse combustion chamber, at least a portion of said resonance tube being contained within said resonance chamber;

at least one nozzle positioned at said open end of said resonance chamber in communication with said resonance tube, said nozzle for accelerating said pulsating combustion products flowing therethrough and for creating a pulsating velocity flow field;

a recirculation conduit having first and second ends, said first end being adapted to be in communication with an outlet of a heat exchanging device; and an eductor having an entrance in communication with said at least one nozzle and with said second end of said recirculation conduit, wherein said eductor mixes said pulsating flow of combustion products emitted from said pulse combustion device with a recycled stream of combustion products exiting said heat exchanging device to form an effluent, said eductor directing said effluent into said heat exchanging device for providing heat thereto.

16. A pulsating apparatus as defined in claim 15, wherein said eductor is a venturi.

17. A pulsating apparatus as defined in claim 15, wherein said recirculation conduit includes a recirculation chamber concentric with said resonance chamber and defining a space therebetween for the passage of said recycled stream of combustion products exiting said heat exchanging device.

18. A pulsating apparatus as defined in claim 15, wherein said resonance chamber is coupled with said at least one resonance tube in a manner such that a standing wave is created in said resonance chamber.

19. A pulsating apparatus as defined in claim 15, wherein, said pulsating flow of combustion products produced by said pulse combustion device has a temperature in the range of from about 1,000° F. to about 3,000° F. when exiting said resonance chamber.

20. A pulsating apparatus as defined in claim 15, wherein said pulse combustion device produces said acoustic pressure wave at a sound pressure level in a range from about 161 dB to about 194 dB and at a frequency in a range from about 50 Hz to about 500 Hz.

* * * * *